US006264546B1

(12) United States Patent
Iida et al.

(10) Patent No.: US 6,264,546 B1
(45) Date of Patent: Jul. 24, 2001

(54) COIN DISCHARGE DEVICE

(75) Inventors: Nobuyuki Iida, Tsurugashima; Yasushi Onodera, Tanzawa-gun; Ryoji Yamagishi, Kawagoe, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/412,112

(22) Filed: Oct. 5, 1999

(30) Foreign Application Priority Data

Oct. 6, 1998 (JP) ..... 10-284519
Jan. 27, 1999 (JP) ..... 11-018579

(51) Int. Cl.[7] ..... G07D 9/00
(52) U.S. Cl. ..... 453/17; 194/350
(58) Field of Search ..... 453/17, 63; 194/350

(56) References Cited

U.S. PATENT DOCUMENTS 4,374,529 * 2/1983 Kobayashi et al. ..... 453/17
4,436,102 * 3/1984 Kokubo et al. ..... 453/17
5,947,257 * 9/1999 Schwartz ..... 453/32 X

* cited by examiner

*Primary Examiner*—F. J. Bartuska
(74) *Attorney, Agent, or Firm*—Hogan & Hartson, LLP

(57) ABSTRACT

A coin discharge device has a removable coin tube cassette and an empty sensor 5 for accurately detecting the presence of coins within the coin tubes. A sensor mounting 30 is designed to withdraw the sensor 5 from the cassette accommodation part 22 when the coin tube cassette is removed from the device. However, when the coin tube device is inserted into the cassette accommodation part 22, the sensor mounting 30 moves the sensor 5 into the accommodation part 22 so that it abuts one side of the coin tube cassette to sense coins therein.

4 Claims, 11 Drawing Sheets

COIN DISCHARGE DEVICE

BACKGROUND OF THE INVENTION

1. Field of the Invention

The present invention relates to improvement of a coin discharge device for discharging coins according to the amount of change from a cassette type coin tube to be mounted so as to freely mount and demount.

2. Description of the Related Art

Generally in a device such as a vending machine, a coin processing device for ascertaining the truth of input coins and discharging coins according to the amount of change is mounted.

This coin processing device broadly comprises:

(1) a coin sorting device for ascertaining the truth and falsity of input coins, returning false coins, discriminating the kind of true coins, and separating and sorting them and (2) a coin discharge device for accommodating true coins separated and sorted by the coin sorting device for each coin kind and discharging coins according to the amount of change.

Among them, the coin discharge device comprises a cassette type coin tube for loading and accommodating specific coins which is mounted so as to freely mount and demount and a coin discharge unit for discharging coins from the lowest surface of the coin tube.

FIG. 9 is a side view of essential section breakage concept showing a conventional coin discharge device 1. The coin discharge device 1, unlike a coin discharge device for so-called discharging a plurality of coin kinds for sorting and accommodating a plurality of kinds of coins and selecting and discharging the coin kind according to the amount of change among them, is a coin discharge device for accommodating and discharging only coins of particularly high use frequency and this type of coin discharge device 1 is generally arranged contiguously to the aforementioned coin discharge device for discharging a plurality of coin kinds in the coin processing device.

The coin discharge device 1 comprises a device body 3 consisting of a frame in which a cassette accommodation concave part 2 for accommodating one cassette type coin tube for accommodating only specific coins of high use frequency which will be described later is formed so as to freely mount and demount and a coin discharge means 4 arranged at the lower part of the device body 3.

For a concrete structure of the coin discharge means 4, it is recommended to refer to Japanese Utility Model Patent 60-44160 proposed by this applicant previously.

In the coin discharge device 1, an empty sensor 5 for detecting the existence of coins accommodated in the cassette type coin tube which will be described later is arranged under a back 2*a* of the cassette accommodation concave part 2. The empty sensor 5 comprises a coil wound in a circle to which a predetermined high frequency signal is applied and detects the existence of coins as a change in the impedance of the coil. The empty sensor 5 is covered with synthetic resin such as rubber so that the coil will not be damaged so much by an external shock. The empty sensor 5 is mounted via a spring 6 in a sensor accommodation concave part 2*b* formed on the back 2*a* of the cassette accommodation concave part 2 so that a tip 5*a* thereof freely comes in and out from the cassette accommodation concave part 2.

The cassette type coin tube is mounted in the cassette accommodation concave part 2 of the coin discharge device 1, as shown in FIG. 10, by fitting and inserting a lower end 10*a* of one cassette tube 10 under the cassette accommodation concave part 2, rotating a tip 10*b* in the direction of the arrow F, that is, counterclockwise on the drawing using it as a fulcrum, and joining the tip 10*b* of the coin tube 10 to a joining pawl 11*a* of a latch means 11 formed on the top of the device body 3 as shown in FIG. 11.

In this case, the tip 5*a* of the empty sensor 5 is closely adhered to the lower part of a back 10*c* of the coin tube 10 by the force of the spring 6.

Numeral 13 shown in FIGS. 9 to 11 indicates a control board for the empty sensor 5 mounted on the back of the device body 3.

Meanwhile, in the aforementioned conventional coin discharge device 1, the empty sensor 5 detects the existence of remaining coins accommodated in the coin tube 10, so that it is often arranged at the corresponding part of the lower part of the coin tube 10, and in this case, when the lower end 10*a* of the coin tube 10 is to be mounted in the cassette accommodation concave part 2 as shown in FIG. 10, it is apt to collide with the back 10*c* of the coin tube 10, and when it is repeated, the empty sensor 5 itself is damaged and hence cannot detect the existence of remaining coins, and there is a risk that the stable coin discharge function of the coin discharge device 1 cannot be maintained.

SUMMARY OF THE INVENTION

In view of the above situation, the present invention is intended to provide a coin discharge device for stably detecting the existence of remaining coins accommodated in a cassette type coin tube.

To solve the aforementioned problems, the present invention provides a coin discharge device including at least a device body having a cassette accommodation concave part to which a cassette type coin tube is mounted so as to freely mount and demount and an empty sensor which is arranged on one side of the cassette accommodation concave part and detects the existence of remaining coins accommodated in the cassette type coin tube, wherein the empty sensor is always withdrawn from the cassette accommodation concave part and arranged in a sensor mounting means for projecting it into the cassette accommodation concave part when the cassette type coin tube is mounted in the cassette accommodation concave part and closely adhering it to one side of the cassette type coin tube.

DESCRIPTION OF THE PREFERRED EMBODIMENTS

An embodiment of a coin discharge device relating to the present invention will be described hereunder in detail.

Figure 1:
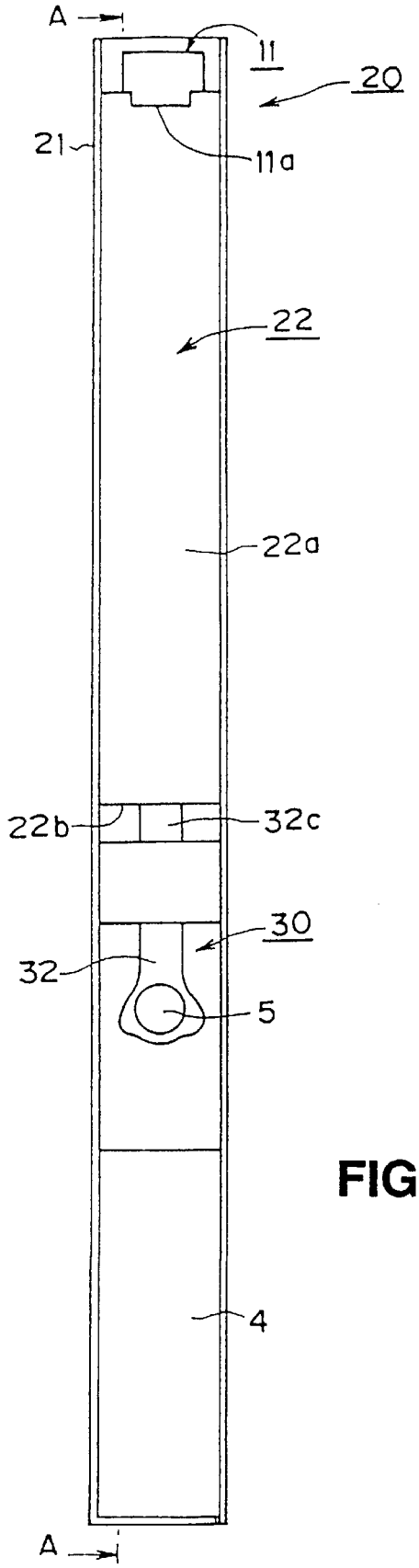
FIG. 1 is a conceptual front view of a coin discharge device relating to the present invention.
Figure 9:
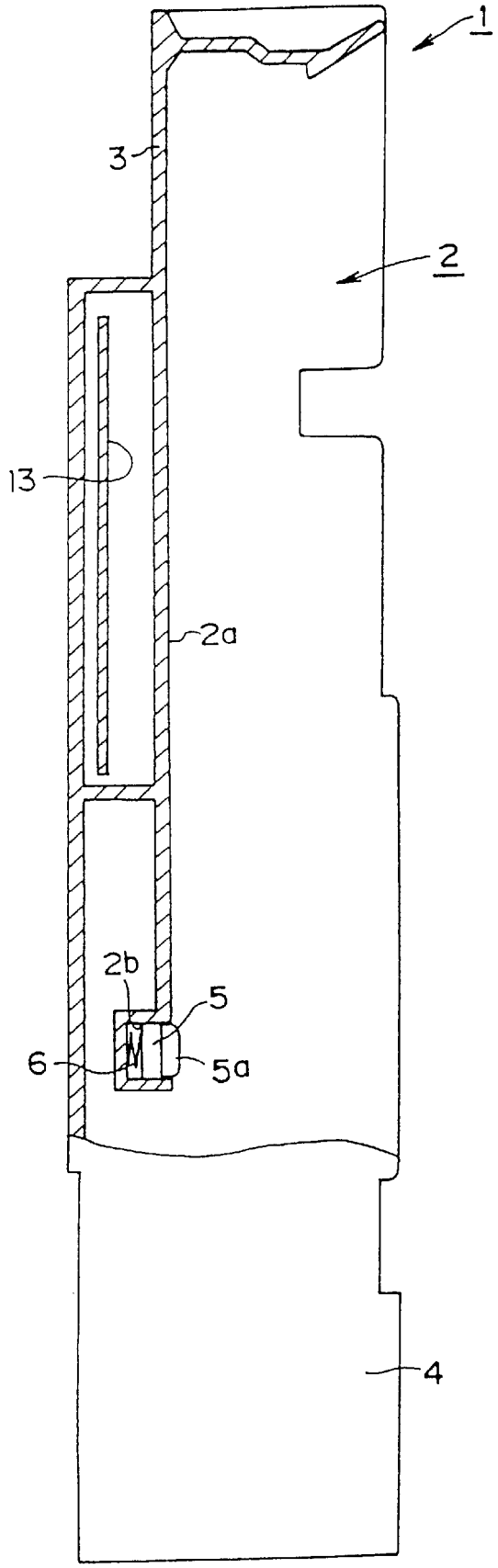
FIG. 9 PRIOR ART
FIG. 9 is a cross sectional view of essential section breakage concept of a conventional coin discharge device.
Figure 10:
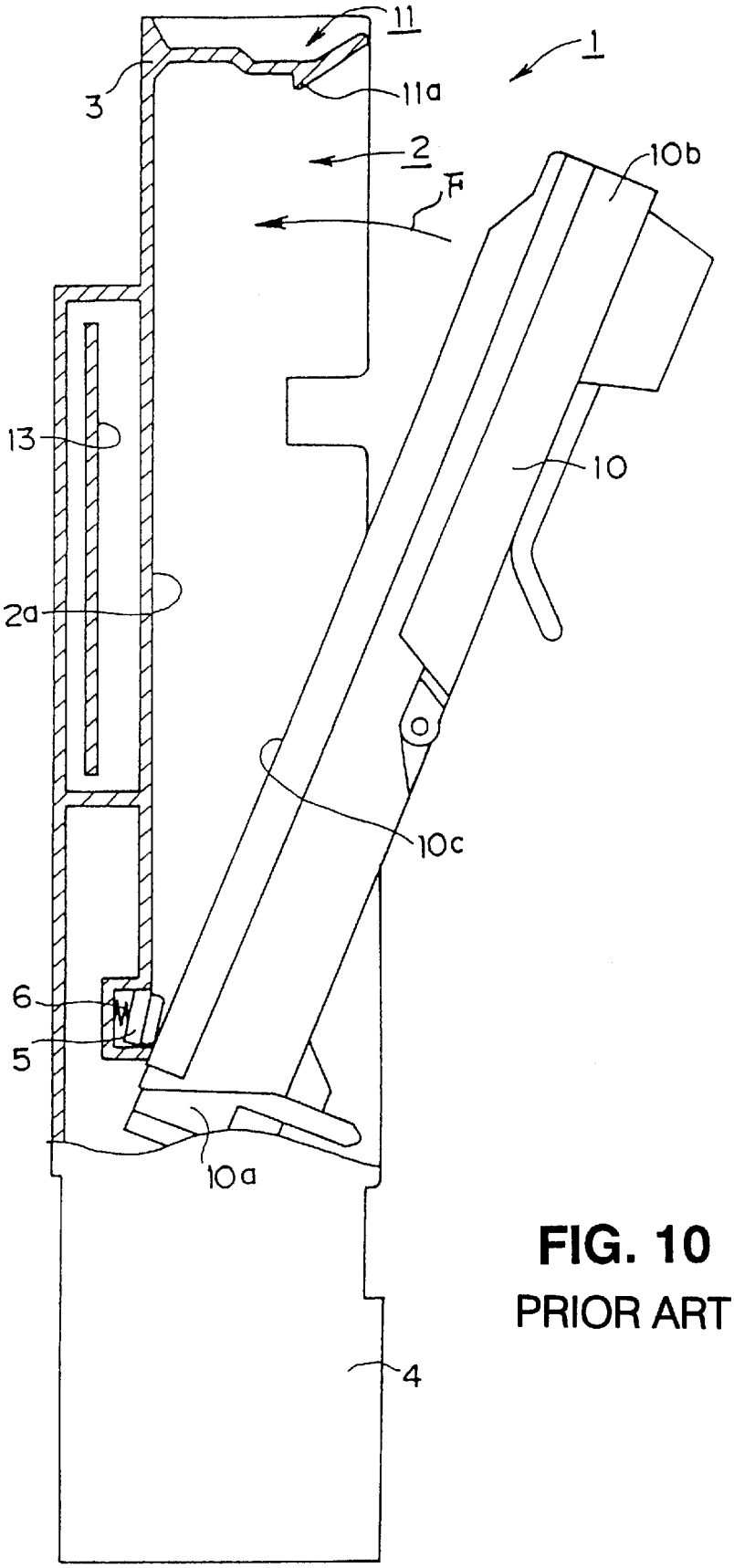
FIG. 10 PRIOR ART
FIG. 10 is a cross sectional view of essential section breakage concept showing the operation of a conventional coin discharge device.
Figure 11:
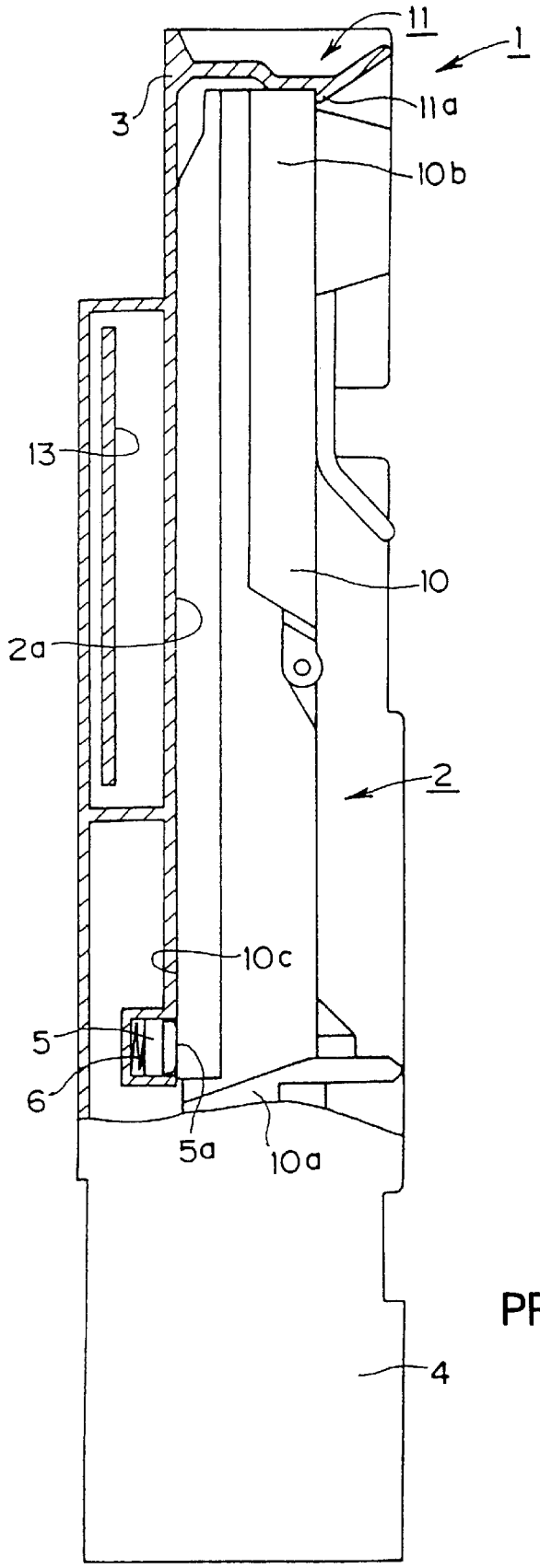
FIG. 11 PRIOR ART
FIG. 11 is a cross sectional view of essential section breakage concept showing the operation of a conventional coin discharge device.

FIG. 1 is a front view of a coin discharge device 20 relating to the present invention and the same numeral is assigned to each of the same parts as those shown in FIGS. 9 to 11.

On the front of a device body 21 which is a frame of the coin discharge device 20, a cassette accommodation concave part 22 for mounting the cassette type coin tube 10 so as to freely mount and demount is formed and at the lower part of a back 22*a* of the cassette accommodation concave part 22, the empty sensor 5 is mounted via a sensor mounting means 30. At the lower part of the device body 21, the coin discharge means 4 is arranged in the same way as with a conventional one.

Figure 2:
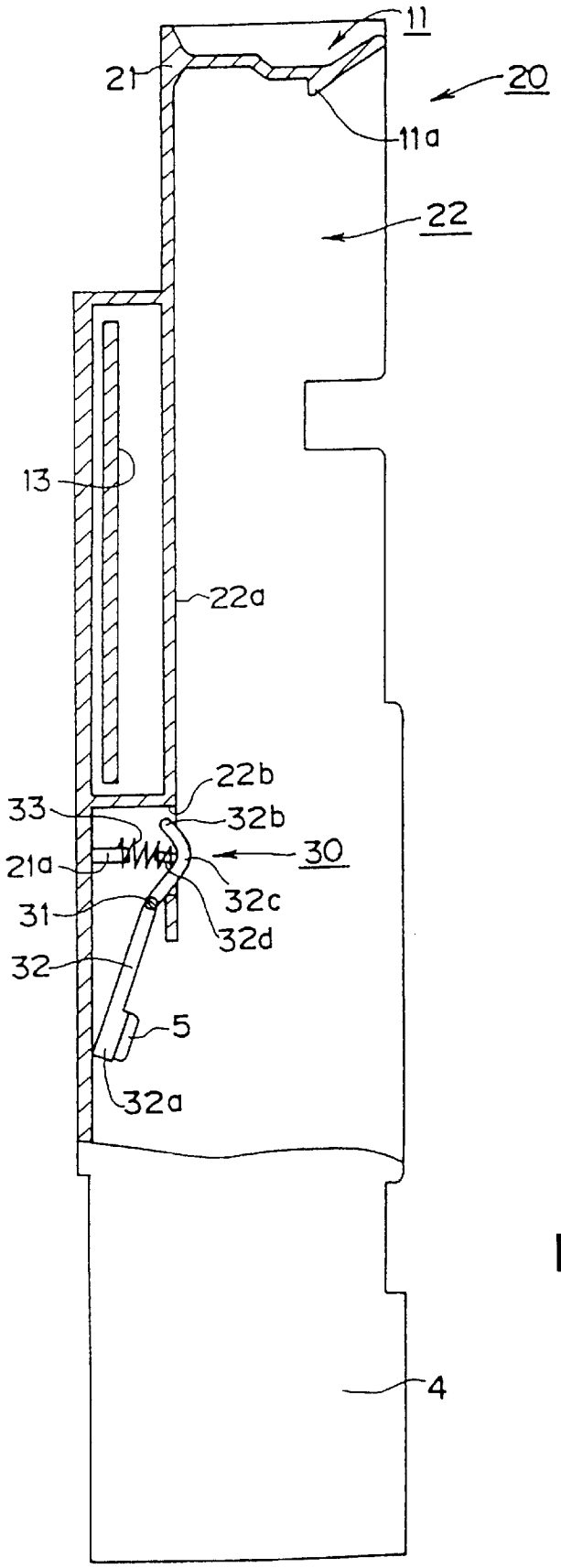
FIG. 2 is a cross sectional view of breakage concept of the essential section AA shown in FIG. 1.

The sensor mounting means 30, as shown in the cross sectional view of breakage concept of the essential section AA shown in FIG. 1, which is shown in FIG. 2, comprises an almost L-shaped lever 32 supported at the lower part of the device body 21 so as to freely rotate round a shaft 31.

Both ends of the shaft 31 are supported at the bearing parts formed at predetermined positions of the device body 21 so as to freely rotate.

The lever 32 is made of comparatively rigid synthetic resin covering the empty sensor 5, and at a lower end 32*a* thereof, the empty sensor 5 is arranged, and an upper end 32*b* is bent, and a central part 32*c* thereof is formed so as to project through a hole 22*b* formed in the back 22*a* of the cassette accommodation concave part 22 into the cassette accommodation concave 22.

On the back of the central part 32*c* of the bent upper end 32*b* of the lever 32, a pin 32*d* is projected and between the pin 32*d* and a pin 21*a* projected on the inner peripheral surface of the device body 21 at the opposite position, a spring 33 for always forcing the bent central part 32*c* of the lever 32 clockwise round the shaft 31 is arranged.

As a result, the bent central part 32*c* of the lever 32 is always (that is, when the cassette type coin tube 10 is not mounted in the cassette accommodation concave part 22) projected in the cassette accommodation concave part 22 from the hole 22*b* formed in the back 22*a* of the cassette accommodation concave part 22, and the lower end 32*a* of the lever 32 where the empty sensor 5 is arranged rotates at a predetermined angle clockwise round the shaft 31, and by doing this, the lower end 32*a* is positioned at the place where it is withdrawn from the cassette accommodation concave part 22.

Next, the operation of the sensor mounting means 30 will be explained.

As shown in FIG. 2, when the cassette type coin tube 10 is not mounted in the cassette accommodation concave part 22, by the force of the spring 33, the bent central part 32*c* of the lever 32 is always projected in the cassette accommodation concave part 22 through the hole 22*b* formed in the back 22*a* of the cassette accommodation concave part 22 and the lower end 32*a* of the lever 32 where the empty sensor 5 is arranged is positioned in the place where it is withdrawn from the cassette accommodation concave part 22.

Figure 3:
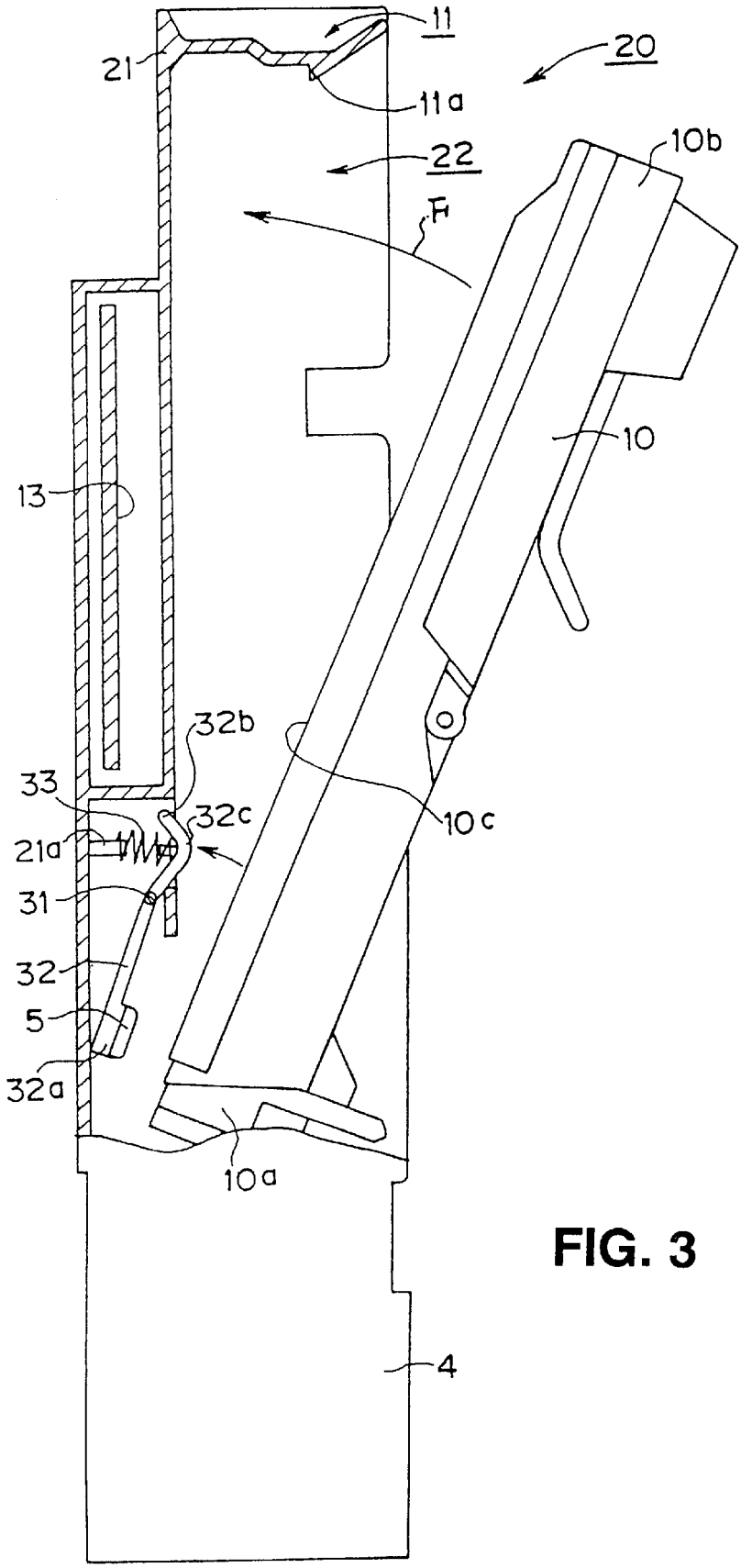
FIG. 3 is a cross sectional view of essential section breakage concept showing the operation of a coin discharge device relating to the present invention.

Next, as shown in FIG. 3, the lower end 10*a* of one cassette tube 10 is fit and inserted into the lower part of the cassette accommodation concave part 22.

In this case, since the empty sensor 5 is positioned in the place where it is withdrawn from the cassette accommodation concave part 22 by rotation of the lever 32, it will not collide with the back 10*c* of the coin tube 10 and hence the risk that the empty sensor 5 itself may be damaged is reduced as much as possible.

Figure 4:
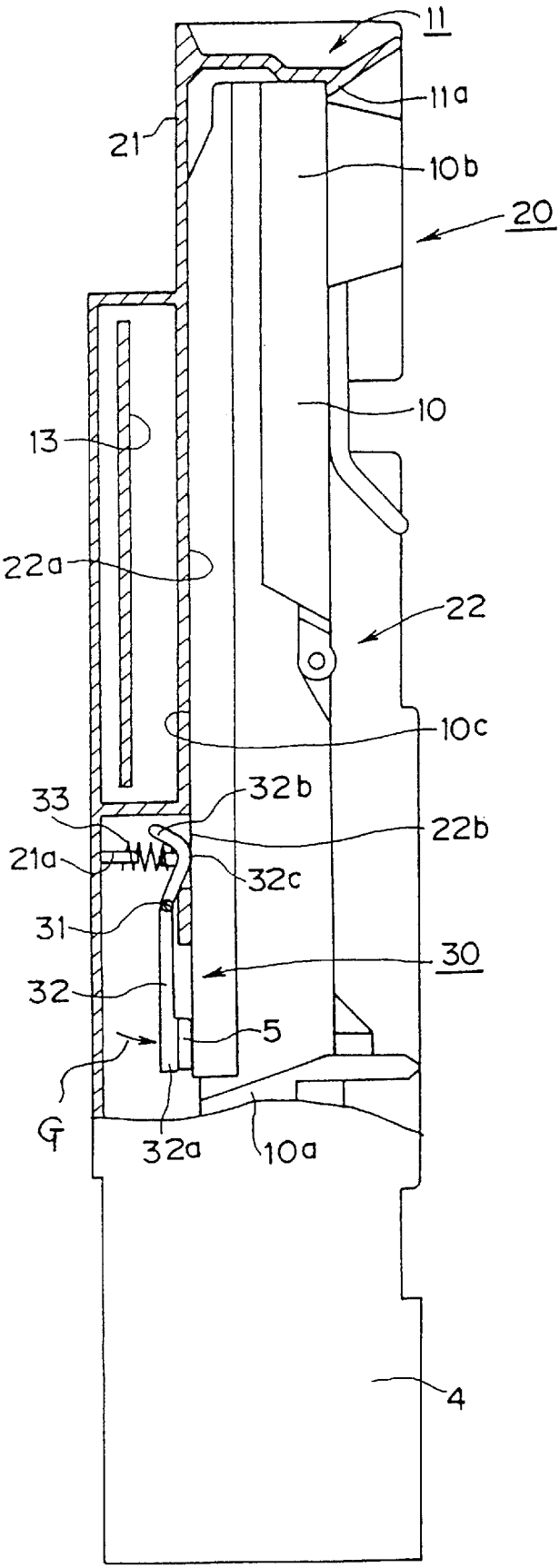
FIG. 4 is a cross sectional view of essential section breakage concept showing the operation of a coin discharge device relating to the present invention.

Thereafter, when the upper end 10*b* of the cassette tube 10 is rotated in the direction of the arrow F, that is, counterclockwise on the drawing, as shown in FIG. 4, firstly the bent central part 32*c* of the lever 32 colliding with the back 10*c* of the coin tube 10 comes in contact with it and the lever 32 is rotated in the direction of the arrow G, that is, counterclockwise by the force round the shaft 31.

Then, the empty sensor 5 positioned at the lower end 32*a* of the lever 32 rotates counterclockwise round the shaft 31, closely adheres to a predetermined position of the back 10*c* of the coin tube 10 surely, and positioned and arranged in the place.

Therefore, in the aforementioned coin discharge device 20, when the coin tube 10 is mounted, the coin tube 10 does not collide with the empty sensor 5, so that the damage of the empty sensor 5 can be reduced as much as possible.

In the aforementioned embodiment, the lever 32 where the empty sensor 5 is arranged is supported just so as to freely rotate round the shaft 31. However, when an error occurs in the forming position of a bearing part, not shown in the drawing, formed in the device body 21 which supports the shaft 31 so as to freely rotate and when the coin tube 10 is mounted in the cassette accommodation concave part 22, there is a risk that the following problem is caused.

Namely, when an error occurs in the forming position of the bearing part for supporting the shaft 31 so as to freely rotate and when the coin tube 10 is mounted in the cassette accommodation concave part 22, the central part 32*c* of the lever 32 and the empty sensor 5 come in contact with the back 10*c* of the coin tube 10 by strong force and hence a strong load is applied to the shaft 31 and there is a risk that it may be broken.

Figure 5:
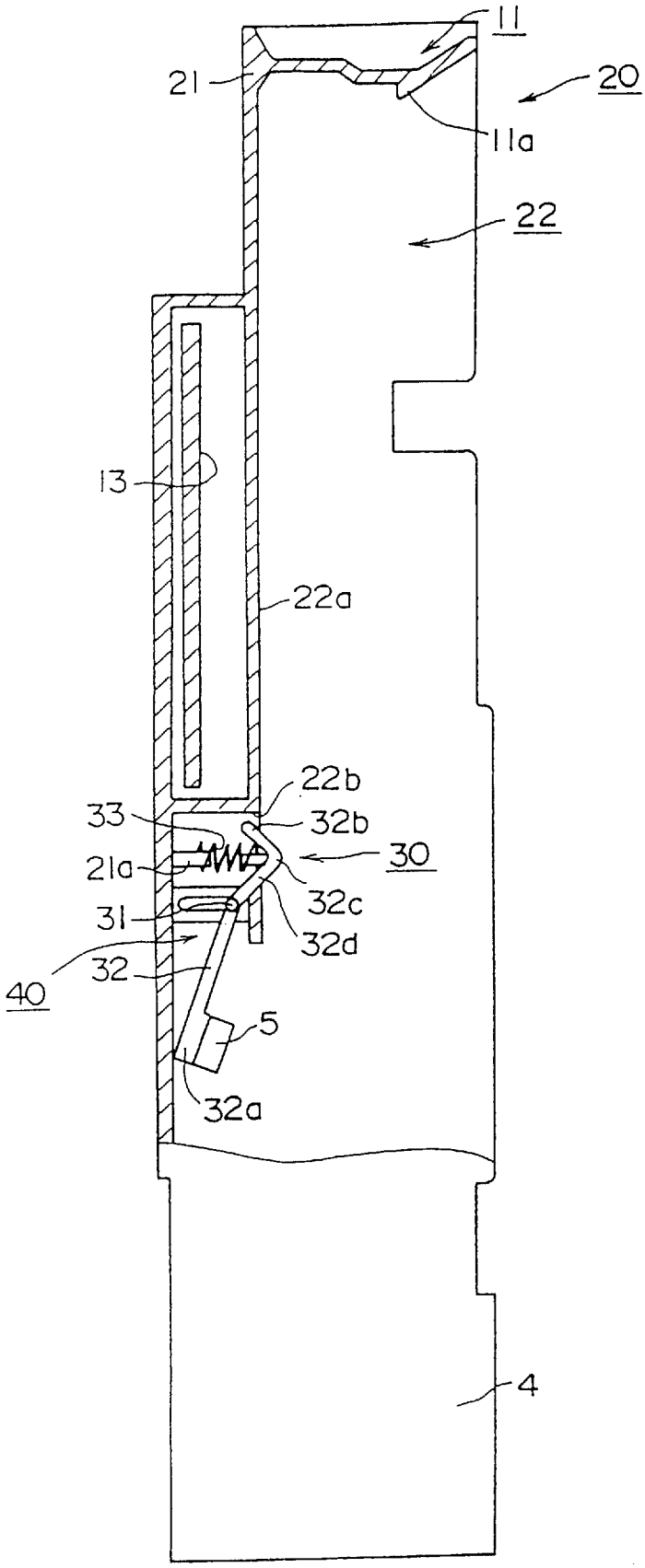
FIG. 5 is a cross sectional view of essential section concept showing another embodiment of a coin discharge device relating to the present invention.
Figure 6:
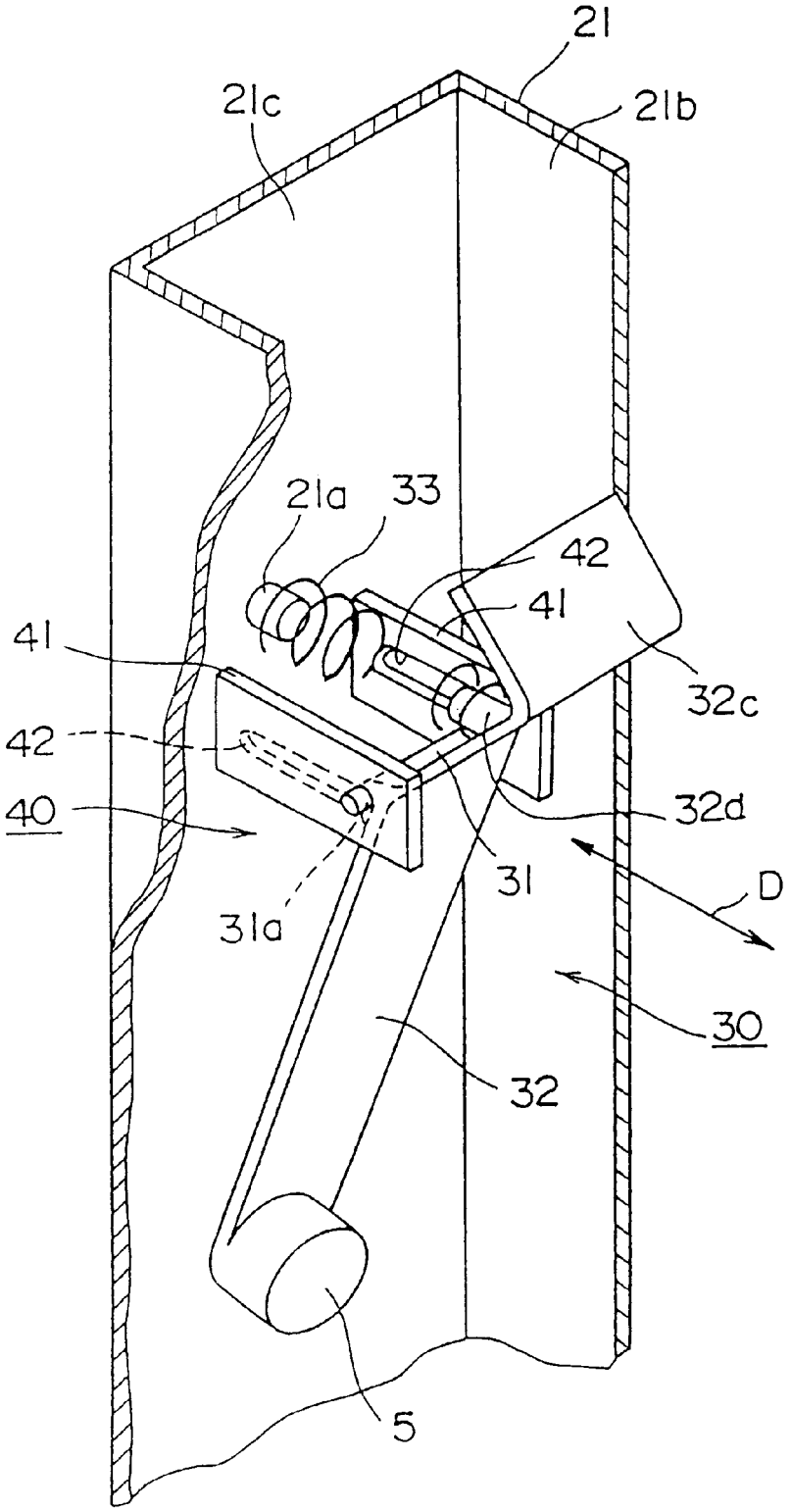
FIG. 6 is a perspective view of essential section breakage of a coin discharge device showing a sliding means.

Accordingly, to eliminate such risks, like the coin discharge device 20 of another embodiment shown in FIG. 5, in which the same numeral is assigned to each of the same parts as those shown in FIG. 2, the shaft 31 supporting the lever 32 so as to freely rotate may be supported via a sliding means 40 so as to freely slide toward the arrangement side (the cassette accommodation concave part 22 side) of the coin tube. FIG. 6 is an enlarged perspective view of essential section breakage of the device body 21 showing the sliding means 40 in detail.

In a concave part 21*b* formed in the device body 21, a lever 32 constituting the sensor mounting means 30 is accommodated and the shaft 31 supporting the lever 32 is supported via the sliding means 40 so as to freely slide in the direction of the arrow D (the arrangement side of the coin tube).

The sliding means 40 comprises a pair of guide plates mounted to the back 21*c* of the concave part 21*b* and guide grooves 42 formed in the guide plates 41 and the guide grooves 42 support each end part 3l*a* of the shaft 31 so as to freely rotate and freely slide in the direction of the arrow D.

The guide grooves 42 are formed in the direction of the arrow D as shown in the drawing.

Figure 7:
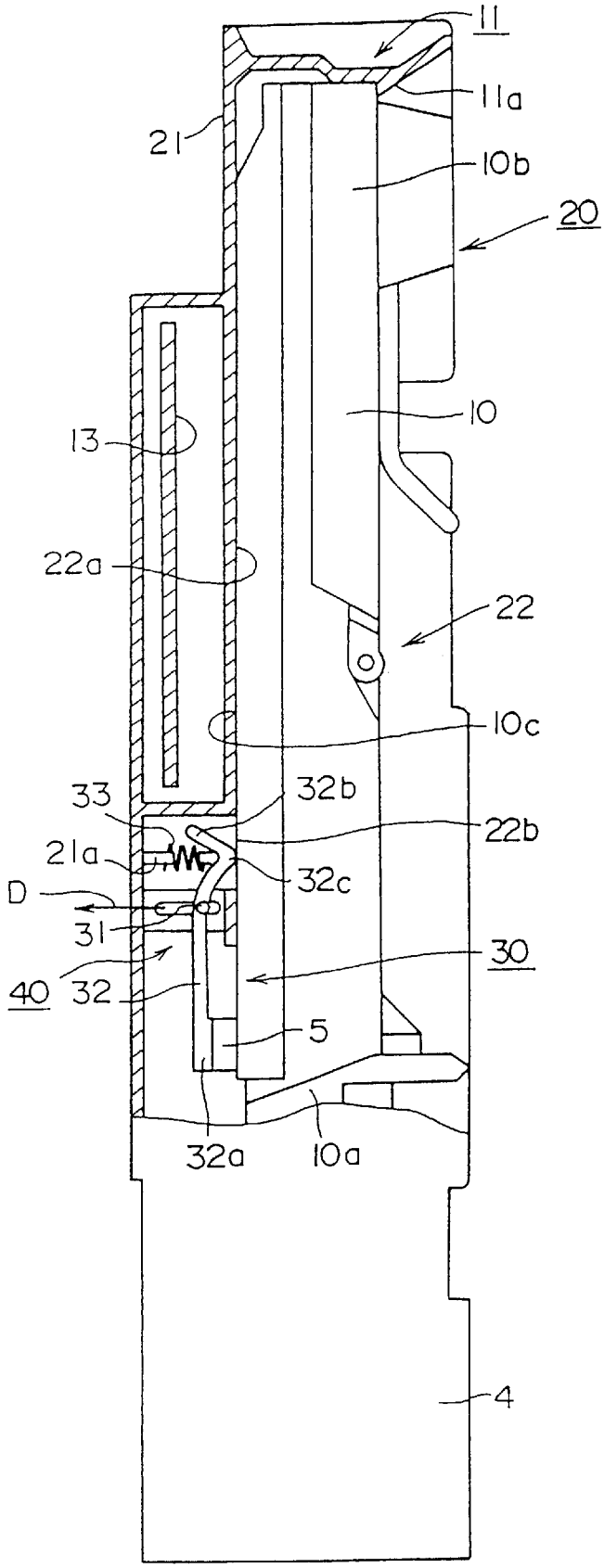
FIG. 7 is a cross sectional view of essential section breakage concept of a coin discharge device showing the operation of another embodiment.

In the sensor mounting means 30 with this sliding means 40 added, as shown in FIG. 7, when one cassette tube 10 is mounted in the cassette accommodation concave part 22, the empty sensor 5 positioned at the lower end 32*a* of the lever 32 rotates counterclockwise round the shaft 31, closely adheres to a predetermined position of the back 10*c* of the coin tube 10 surely, and positioned and arranged in the place.

In this case, even if there is a little arrangement error in the bearing part supporting the shaft 31 of the lever 32, the shaft 31 slides and withdraws in the direction of the arrow D by the sliding means 40 and can absorb the arrangement error, so that when the coin tube 10 is mounted, the central part 32*c* of the lever 32 and the empty sensor 5 will not come in contact with the back 10*c* of the coin tube 10 by strong force and hence damage such that the shaft 31 is broken by a strong load can be prevented as much as possible.

As mentioned above, the shaft 31 of the lever 32 is supported via he sliding means 40 so as to freely slide toward the arrangement side of the coin tube 10, so that even if there is a little processing or mounting error reversely on the coin tube 10 side, particularly the back 10*c* side of the coin tube 10, the shaft 31 absorbs it and the empty sensor 5 can be closely adhered at a predetermined position of the back 10*c* of the coin tube 10 surely.

Figure 8:
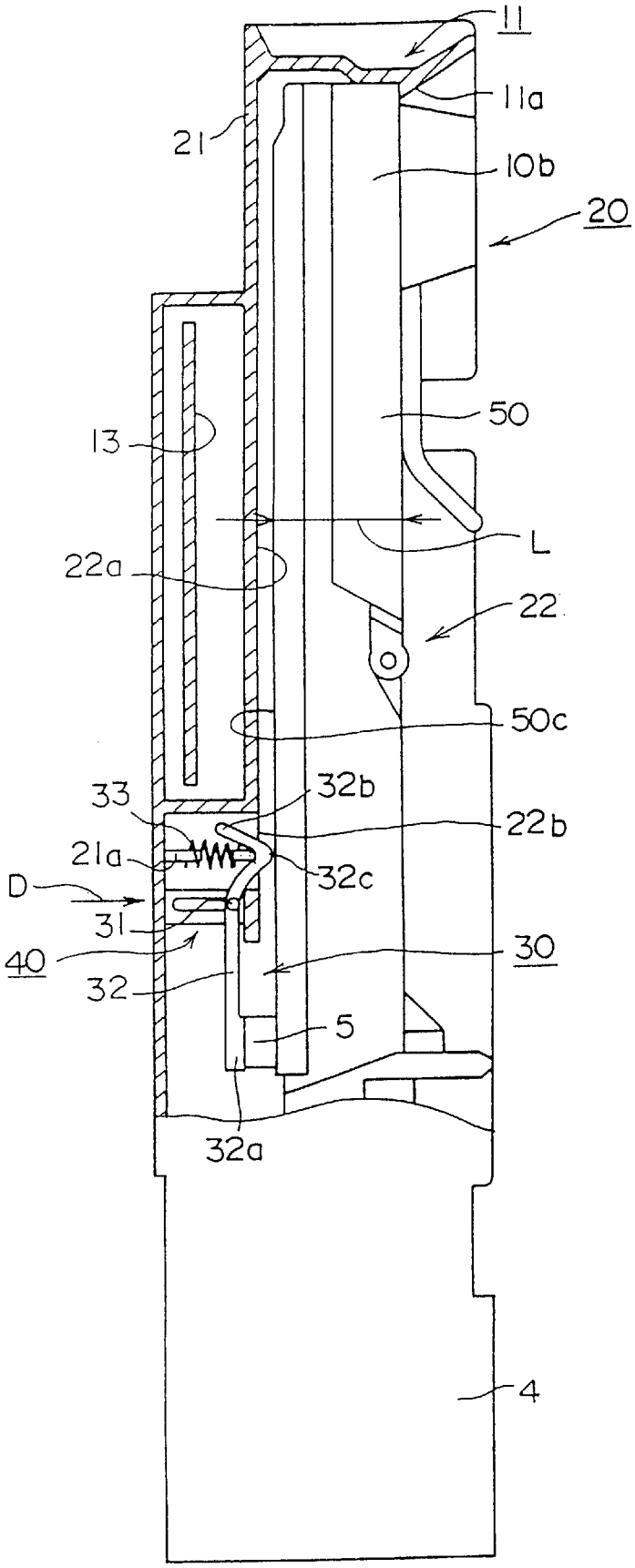
FIG. 8 is a cross sectional view of essential section breakage concept of a coin discharge device showing the operation of another embodiment.

Furthermore, not only a mounting or processing error of the coin tube 10 but also, for example, when a coin tube accommodating coins with a small diameter and a small lateral width is to be mounted, it is conventionally necessary to prepare a coin discharge device whose size corresponds to it. However, in the sensor mounting means 30 with the sliding means 40 added, even if a coin tube 50 accommodating coins with a small diameter and a small lateral width L as shown in FIG. 8 in which the same numeral is assigned to each of the same parts as those shown in FIG. 7 is mounted in the cassette accommodation concave part 22, the shaft 31 slides in the direction of the arrow D by the sliding means 40 and absorbs the shape change, so that it is possible to closely adhere the central part 32*c* of the lever 32 and the empty sensor 5 at a predetermined position of a front 50*c* of the coin tube 50 by it and surely position and arrange the empty sensor 5 at a predetermined position of the front 50*c* of the coin tube 50.

In the aforementioned embodiment, a case that the sensor mounting means 30 for supporting the empty sensor 5 is applied to the coin discharge device 20 with one coin tube 10 or 50 mounted is described in detail. However, the present invention is not limited to the aforementioned embodiment and needless to say, it may be applied to an empty sensor of a coin discharge device for so-called discharging a plurality of coin kinds for sorting and accommodating a plurality of kinds of coins and selecting and discharging the coin kind according to the amount of change among them.

As described above, in the coin discharge device of the present invention, the empty sensor for detecting the existence of remaining coins accommodated in the cassette type coin tube is always withdrawn from the cassette accommodation concave part and arranged via the sensor mounting means for projecting it from the cassette accommodation concave part when the cassette type coin tube is mounted in the cassette accommodation concave part and closely adhering it to one side of the coin tube, so that a coin discharge device that when the cassette type coin tube is to be mounted in the cassette accommodation concave part, the empty sensor and the coin tube do not collide with each other, and hence the damage of the empty sensor is reduced as much as possible, and the existence of remaining coins can be stably detected can be provide.

Since the empty sensor closely adheres to a predetermined position on one side of the cassette type coin tube more surely via the sensor mounting means, the distance between coins accommodated in the coin tube and the empty sensor is more accurate and hence the accuracy of detection of the existence of coins by the empty sensor can be enhanced more.

Since the sensor mounting means freely slides toward one side of the coin tube via the sliding means, it can not only absorb a mounting error of the sensor mounting means or a processing error of the coin tube but also surely arrange the empty sensor at a predetermined position of the coin tube even if a coin tube with a different size is mounted.

The present invention can be executed in various forms without deviated from the spirit or main characteristics. Therefore, the aforementioned embodiments are only examples in every respect and must not be interpreted limitatively. The scope of the present invention is indicated by the claims but not limited to the text of the specification. Furthermore, deformations and changes belonging to the average scope are all within the scope of the invention.

What is claimed is:

1. A coin discharge device comprising:

a device body having a cassette accommodation concave part in which a cassette type coin tube is removably mounted;

an empty sensor arranged on one side of the cassette accommodation concave part for detecting existence of remaining coins in the cassette type coin tube; and sensor mounting means disposed in the device body, for withdrawing the empty sensor from the cassette accommodating concave part when the cassette type coin tube is not mounted in the cassette accommodation concave part, and for projecting the empty sensor into the cassette accommodation concave part so that the empty sensor abuts one side of the cassette type coin tube when the cassette type coin tube is mounted in the concave cassette accommodation part.

2. The coin discharge device according to claim 1, wherein the sensor mounting means comprises a lever pivotally supported by a shaft disposed at a lower part of the device body, and configured so that a lower end thereof supports the empty sensor and so that a force means projects an upper end of said lever into the cassette accommodation concave part when the cassette type coin tube is mounted therein, with the upper end of the lever pressed against the force means on one side of the cassette type coin tube and the empty sensor disposed at the lower end of the lever projecting into the cassette accommodation concave part and abutting one side of the cassette type coin tube.

3. The coin discharge device according to claim 1, wherein the sensor mounting means comprises:

a lever pivotally supported by a shaft disposed at a lower part of the device body and configured so that a lower end thereof supports the empty sensor;

force means for projecting an upper end of the lever into the cassette accommodation concave part when the cassette type coin tube is not mounted therein; and sliding means for supporting the shaft to freely slide towards the cassette accommodation concave part so that when the cassette type coin tube is mounted in the cassette accommodation concave part, the upper end of the lever is pressed against the force means on one side of the cassette type coin tube and the empty sensor disposed at the lower end of the lever projects into the cassette accommodation part and abuts one side of the cassette type coin tube.

4. The coin discharge device according to claim 3, wherein the sliding means comprises a pair of guide plates projecting into the device body, and guide grooves formed in each of the guide plates for supporting one end of the shaft so that the shaft freely rotates and freely slides.

* * * * *